US010436153B2

(12) United States Patent
Mainusch et al.

(10) Patent No.: US 10,436,153 B2
(45) Date of Patent: Oct. 8, 2019

(54) FUEL VAPOUR TEMPORARY STORAGE DEVICE

(71) Applicant: GM GLOBAL TECHNOLOGY OPERATIONS LLC, Detroit, MI (US)

(72) Inventors: Thomas Mainusch, Schwabenheim (DE); Klaus Thiemann, Mainz (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/995,233

(22) Filed: Jun. 1, 2018

(65) Prior Publication Data

US 2018/0347512 A1 Dec. 6, 2018

(30) Foreign Application Priority Data

Jun. 1, 2017 (DE) ..... 10 2017 005 237

(51) Int. Cl.
*F02M 25/08* (2006.01)
*F02B 63/06* (2006.01)

(52) U.S. Cl.
CPC ..... *F02M 25/089* (2013.01); *F02B 63/06* (2013.01)

(58) Field of Classification Search
CPC ..... F02M 25/08; F02M 25/089; F02B 63/06
See application file for complete search history.

(56) References Cited

U.S. PATENT DOCUMENTS 9,638,144 B2 * 5/2017 Pursifull ..... F02M 25/0836

* cited by examiner

*Primary Examiner* — Hieu T Vo
(74) *Attorney, Agent, or Firm* — Lorenz & Kopf, LLP

(57) ABSTRACT

Fuel vapor temporary storage device includes a collecting tank which is configured to collect fuel and a temporary storage device is configured to collect gas-phase components that are released from fuel located in the collecting tank. A compressor is configured to supply compressed air to the device. A first line creates a fluid connection between the collecting tank and the temporary storage device. A second line creates a fluid connection between the compressor and the temporary storage device. The temporary storage device receives the gas-phase component via the first line and receives compressed air from the compressor via the second line. The temporary storage device has a third line configured to discharge the collected gas-phase components from the temporary storage device to an internal combustion engine when the compressor is supplying compressed air via the second line.

17 Claims, 3 Drawing Sheets

FUEL VAPOUR TEMPORARY STORAGE DEVICE

CROSS-REFERENCE TO RELATED APPLICATION

This application claims priority to German Patent Application No. 102017005237.9, filed Jun. 1, 2017, which is incorporated herein by reference in its entirety.

TECHNICAL FIELD

The present disclosure pertains to a fuel vapor temporary storage device, an internal combustion engine, a motor vehicle and a method for storing fuel vapor temporarily.

BACKGROUND

Fuel vapor temporary storage devices are used in motor vehicles to hold gas-phase components that form or escape from fuel contained in a collecting tank, particularly when the motor vehicle is not used for a prolonged period, but also during operation. The gas-phase components of the fuels are formed by vaporization from the fuel surface. If the tank filler cap on the motor vehicle is opened, these gas-phase components may escape. To prevent this, fuel vapor temporary storage devices are used. A fuel vapor temporary storage device collects these gas-phase components, stores them temporarily and releases them again when necessary, to an internal combustion engine for example.

In fuel vapor temporary storage devices generally known in art, the gas-phase components that escape from the fuel are stored in a temporary storage device and drawn out of the temporary storage device again by a negative pressure created by the operation of an internal combustion engine, and released into the induction tract of the internal combustion engine. However, this is not sufficiently effective particularly in the case of small internal combustion engines which have a small displacement and therefore generate low negative pressure, and therefore disadvantageous.

Accordingly, there is a need to provide an improved fuel vapor temporary storage device.

SUMMARY

In accordance with the present disclosure, a fuel vapor temporary storage device includes a collecting tank or fuel tank that is configured to hold fuel, a compressor that is configured to supply compressed air, and a temporary storage device having a first line providing a fluid connection between the collecting tank and the temporary storage device and a second line providing a fluid connection between the compressor and the temporary storage device. The temporary storage device is configured to collect gas-phase components that escape from fuel located in the collecting tank via the first line, and to receive compressed air from the compressor via the second line. The temporary storage device has a third line configured to discharge the collected gas-phase components from the temporary storage device to an internal combustion engine when the compressor delivers compressed air via the second line.

The collecting tank is a closed receptacle into which fuel may be introduced, through a closable opening such as a filler port and in which it may be kept. The collecting tank is, for example, a tank of a motor vehicle. The compressor is configured to supply compressed air by compression. The compressor may be an exhaust gas turbocharger or an internal combustion engine compressor. The temporary storage device is a closed receptacle configured to collect gas-phase components that are released from the fuel or evaporate therefrom. The temporary storage device may be a "carbon canister", namely a canister filled with activated carbon. The activated carbon binds the vaporized fuel at least briefly or temporarily. The first fluid line is arranged between the collecting tank and the temporary storage device, so that the gases released from the fuel in the collecting tank may flows into the temporary storage device. The second fluid line is arranged between the compressor and the temporary storage device, so that the compressed air which is generated and/or supplied by the compressor is able to flow into the temporary storage device.

The compressor is equipped with a fourth fluid line, which is connected to an internal combustion engine. Now when compressed air which is generated and/or supplied by the compressor flows into the temporary storage device via the second line, the compressed air displaces the gas-phase components held in the temporary storage device, from the activated carbon, and the gas-phases may thus flow out and return to the internal combustion engine via the third line. Upon reaching the internal combustion engine, these gas-phase components are then delivered to an intake device for example, the induction tract, and thus subsequently combusted in the combustion process, so that these gas-phase components are not discharged directly into the environment.

The particular advantage of a fuel vapor temporary storage device in accordance with the present disclosure is that it is exceptionally effective and is also very suitable for internal combustion engines with a small displacement. This fuel vapor temporary storage device has the further advantage, that it may be manufactured particularly easily and inexpensively.

The fuel vapor temporary storage device may be developed further by providing a first valve on the first line, which is configured to close off the first line in a direction of flow from the temporary storage device to the collecting tank. This first valve is arranged in the first line in such manner that although the first line is unobstructed in a flow direction from the collecting tank to the temporary storage device, so that the gas-phase still reach the temporary storage device, in this configuration the first valve closes the line in the opposite flow direction, so that no gas-phase components can flow out of the temporary storage device and back into the collecting tank. This variant also prevents air which is generated and/or supplied by the compressor from at least partly flowing into the collecting tank via the temporary storage device and produces an overpressure. In this variant, the valve is a one-way or check valve.

Optionally, the collecting tank may have a fifth line, which connects the collecting tank to the outside atmosphere. This fifth line may be equipped with a fifth valve, which closes off the fifth line in a flow direction from the collecting tank to the outside atmosphere. This fifth valve may also be a one-way or check valve. In this way, particularly under conditions of negative pressure in the collecting tank, air may be fed into the collecting tank from the outside atmosphere to equalize the negative pressure. This fuel vapor temporary storage device particularly has the advantage that it is highly interference free and not prone to malfunction.

The fuel vapor temporary storage device may be developed further in that the first line is equipped with a first valve which is configured to close off and open the first line. In this variant, the first valve may assume two positions or operating states including a closed operating state in which it closes off the first line in both directions, and an open operating state, in which it allows free flow through the first line. In this variant, the first valve is a two-way valve and may be activated electronically or pneumatically for example. Also in this configuration, the first valve prevents gas-phase components from flowing out of the temporary storage device and back into the collecting tank, and also prevents the air generated and/or supplied by the compressor from at least partly reaching the collecting tank via the temporary storage device and creating an overpressure there, but only when it is closed and blocks off the first line. This fuel vapor temporary storage device particularly has the advantage that it is highly interference free and not prone to malfunction.

The fuel vapor temporary storage device may be developed further in that the temporary storage device also includes a sixth line, which creates a fluid connection between the temporary storage device and the outside atmosphere. The sixth line may be equipped with a sixth valve which is configured to close off and open the sixth line. The sixth line enables formation of a pressure gradient from the collecting tank to the temporary storage device when the fourth line is opened. In this way, the gas-phase components can flow into the collecting tank particularly easily. The sixth valve is able to assume two positions or operating states including a closed operating state, in which it closes off the sixth line in both directions, and an open operating state, in which it allows free flow through the sixth line. The sixth valve may be a two-way-valve and may be activated electronically or pneumatically, for example. This fuel vapor temporary storage device particularly has the advantage that it is highly effective.

The fuel vapor temporary storage device may be developed further in that the second line is equipped with a second valve which is configured to close off and open the second line. The second valve is able to assume to positions or operating states including a closed operating state, in which it closes off the second line in both directions, and an open operating state, in which it allows free flow through the second line. The second valve is for example a two-way valve and may be activated electronically or pneumatically, for example. When it is closed, the second valve prevents gas-phase components from the collecting tank or from the temporary storage device from getting into the compressor and damaging it. Without the second valve, this is particularly likely to happen when the compressor is not working, that is to say not supplying compressed air. This fuel vapor temporary storage device particularly has the advantage that it is highly interference free and not prone to malfunction.

The fuel vapor temporary storage device may be developed further in that the second valve and a fourth valve are configured in such manner that the second valve closes off the second line when the fourth valve allows free flow through the fourth line, and the second valve allows free flow through the second line when the fourth valve closes off the fourth line. This variant makes it possible for the temporary storage device to be connected to the outside atmosphere when the compressor is not in operation, that is to say not supplying compressed air, so that the gas-phase components pass very easily from the collecting tank into the temporary storage device, and when the compressor is in operation the compressed air is able to pass into the temporary storage device particularly easily, and without some or all of it being discharged to the outside atmosphere. Optionally, the second valve and the fourth valve are configured as three-way valves. This fuel vapor temporary storage device particularly has the advantage that it is highly efficient.

The fuel vapor temporary storage device may be developed further in that the first valve is configured such that it closes off the first line when the second valve allows free flow through the second line, and the first valve allows free flow through the first line when the second valve closes off the second line. With this configuration it is possible to ensure that some or all of the compressed air cannot get into the collecting tank when the compressor is in operation. Optionally, the first, second and fourth valves are configured as a single component or an interconnected valve. This fuel vapor temporary storage device particularly has the advantage that it is highly interference free and not prone to malfunction.

The fuel vapor temporary storage device may be developed further in that the collecting tank is equipped with a pressure sensor which is configured to sense or measure the pressure in the interior of the collecting tank. The pressure sensor is configured to detect an overpressure, for example, which arises when compressed air from the compressor gets into the collecting tank. The pressure sensor is further developed to reduce the overpressure or negative pressure in the collecting tank if an overpressure or negative pressure is detected in the collecting tank. This fuel vapor temporary storage device particularly has the advantage that it is highly interference free and not prone to malfunction.

The fuel vapor temporary storage device may be developed further to include a control unit that is configured to actuate the one or more valves in the various lines of the device in such manner that it closes off or allows free flow through the respective line or lines. The control unit may be configured to affect valve opening and closing operations in such manner that the clearing and blocking of the lines described above take place. The control unit may optionally be configured further to determine whether or not the compressor is supplying compressed air. For example, the control unit may be configured to open the first and fourth valve and close the second valve when the compressor is not supplying compressed air, and to open the second valve and close the first and fourth valves when the compressor is supplying compressed air.

The control unit may further be configured to evaluate the value captured by the pressure sensor and to initiate suitable countermeasures if an overpressure or negative pressure is present in the collecting tank, for example closing one or more of the valves, for example the first and/or second valve, or opening one or more valves, for example the fourth.

According to a further embodiment, an internal combustion engine includes a fuel vapor temporary storage device according to one of the embodiments described above. This internal combustion engine may be developed further in that it is also equipped with a intake device, and the temporary storage device is configured to release the gas phase components contained therein to the intake device of the internal combustion engine from the temporary storage device via the third line when the compressor is supplying compressed air via the second line. The internal combustion engine may be developed further in that the compressor is driven by the internal combustion engine.

According to a further embodiment, a motor vehicle is described which includes an internal combustion engine and/or a fuel vapor temporary storage device according to any of the embodiments described above.

According to a further embodiment, a method for storing fuel vapor temporarily is described, which includes collecting the gas-phase components that are released from a fuel located in a collecting tank in a temporary storage device via a first line, closing off a first valve in the first line, supplying compressed air to the collecting tank by means of a compressor via a second line, and releasing gas-phase components contained in the temporary storage device to an internal combustion engine via a third line.

Two different operating modes of an internal combustion engine with a fuel vapor temporary storage device according to at least one of the aforementioned embodiments will be described for exemplary purposes. When the internal combustion engine is switched off, the compressor is not operating and does not supply any compressed air. The second valve is closed. Evaporated fuel and gas-phase components form inside the collecting tank. The first valve and the fourth valve are opened so that the gas-phase components can flow from the collecting tank to the temporary storage device, where they can be collected and stored.

When the internal combustion engine is switched on, the compressor is operating and supplies compressed air. The first and the fourth valves are closed. The second valve is open so that compressed air can flow from the compressor into the temporary storage device, and the gas-phase components stored there can be released or flushed out. In this way, the gas-phase components are discharged from the temporary storage device via the third line and supplied to the induction tract of the internal combustion engine.

In order to avoid repetition, reference is herewith made to the preceding description of the features of the fuel vapor temporary storage device which outlines the advantages, design variants and design details of the device and the method.

BRIEF DESCRIPTION OF THE DRAWINGS

The present disclosure will hereinafter be described in conjunction with the following drawing figures, wherein identical or similar features are designated with the same reference numbers.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
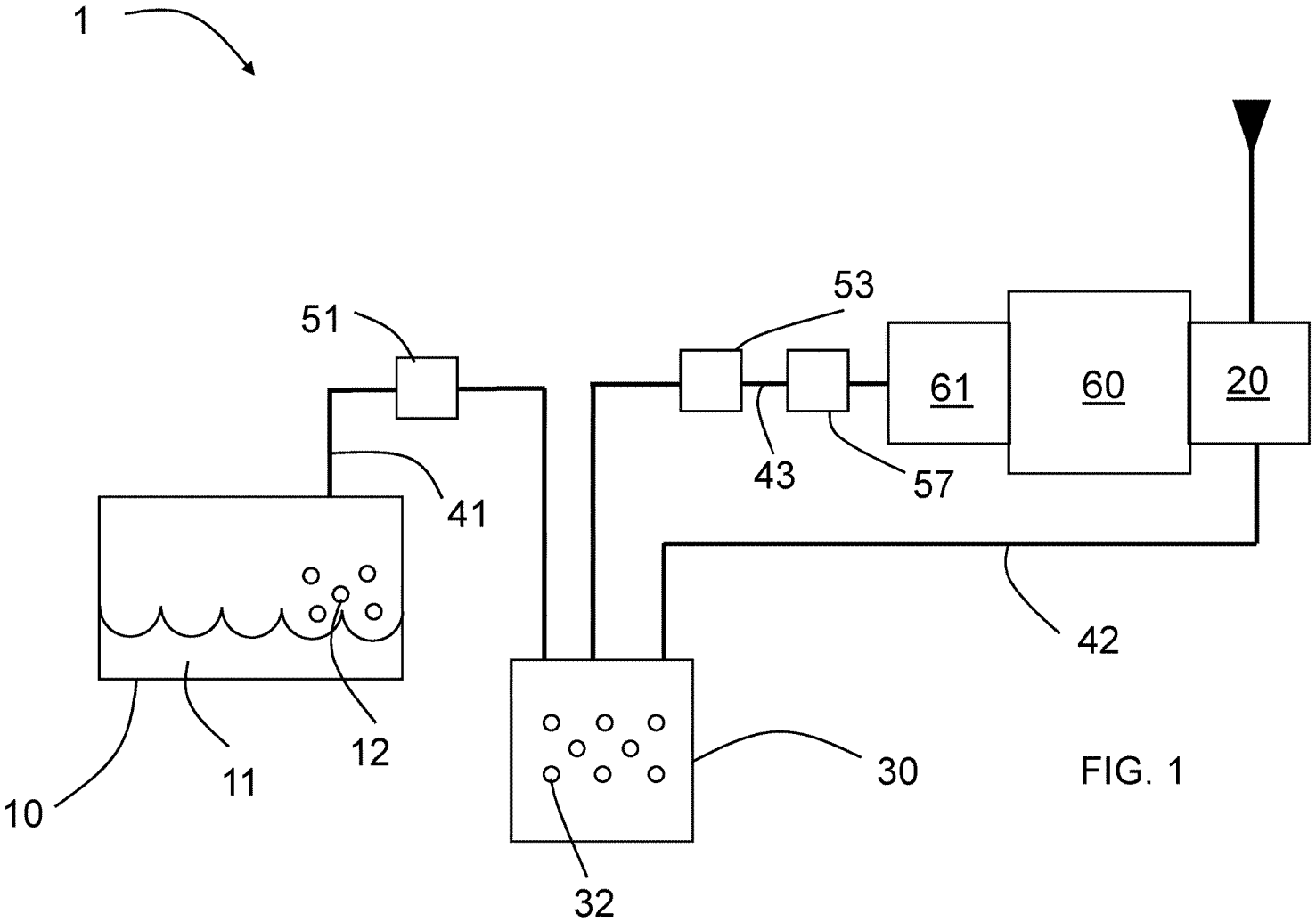
FIG. 1 is a schematic view of a fuel vapor temporary storage device according to the present disclosure.

FIG. 1 shows a fuel vapor temporary storage device 1 including a collecting tank 10 which is configured to collect fuel 11, a compressor 20 which is configured to supply compressed air and a temporary storage device 30. A first line 41 is routed between collecting tank or fuel tank 10 and temporary storage device 30 for creating a fluid connection between collecting tank 30 and temporary storage device 10. A second line 42 is routed between compressor 20 and temporary storage device 30 for creating a fluid connection between compressor 20 and temporary storage device 30.

Temporary storage device 30 is configured to collect gas-phase components 12, 32 which are released from fuel 11 located in collecting tank 10 via first line 41, and to receive compressed air from compressor 20 via second line 42. A third line 43 is routed between collecting tank 10 and temporary storage device 30 and an intake device 61 of an internal combustion engine 60 for discharging the collected gas-phase components 32 from the temporary storage device 30 to the intake device 61 when the compressor 30 supplies compressed air to the temporary storage device 30 via second line 42.

The first line 41 is equipped with a first check valve 51, which closes off the first line 41 in a flow direction from the temporary storage device 30 to the collecting tank 20. The third line 43 is equipped with a third metering valve 53 for dispensing the released gas-phase components 32 to the internal combustion engine 60 in metered quantities. The third line is also equipped with a third check valve 57 which is configured to close off the third line 43 in a flow direction from the internal combustion engine 60 to the temporary storage device 30.

Figure 2:
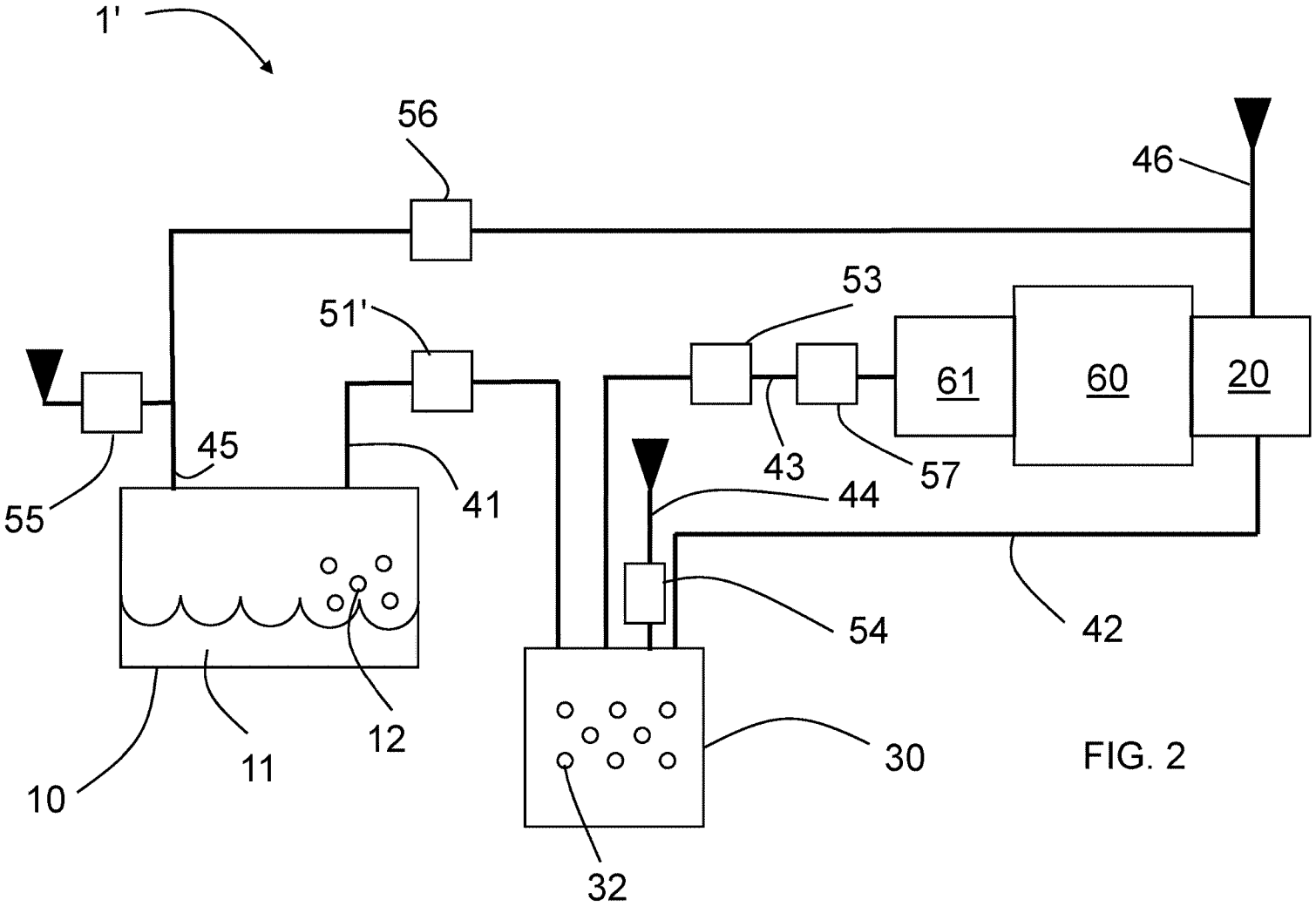
FIG. 2 is a schematic view of an alternate fuel vapor temporary storage device according to the present disclosure.

FIG. 2 shows an alternative fuel vapor temporary storage device 1'. This variant has essentially the same features as the fuel vapor temporary storage device 1 in FIG. 1, and further includes a fourth line 44 creating a fluid connection between the temporary storage device 30 and the outside atmosphere. In this context, the fourth line 44 is equipped with a fourth shut-off valve 54, which is configured to close off and allow free flow through fourth line 44. The first shut-off valve 51' is configured differently from first check valve 51 in FIG. 1 in such manner that it is able to close off and allow flee flow through the first line 41.

Collecting tank or fuel tank 10 is also equipped with a fifth line 45 which connects collecting tank 10 to the outside atmosphere. A fifth check valve 55 closes off the fifth line 45 in a flow direction from collecting tank 10 to the outside atmosphere. The fifth line 45 extends further through a sixth valve 56 and opens into an intake line 46 of the compressor 20.

Figure 3:
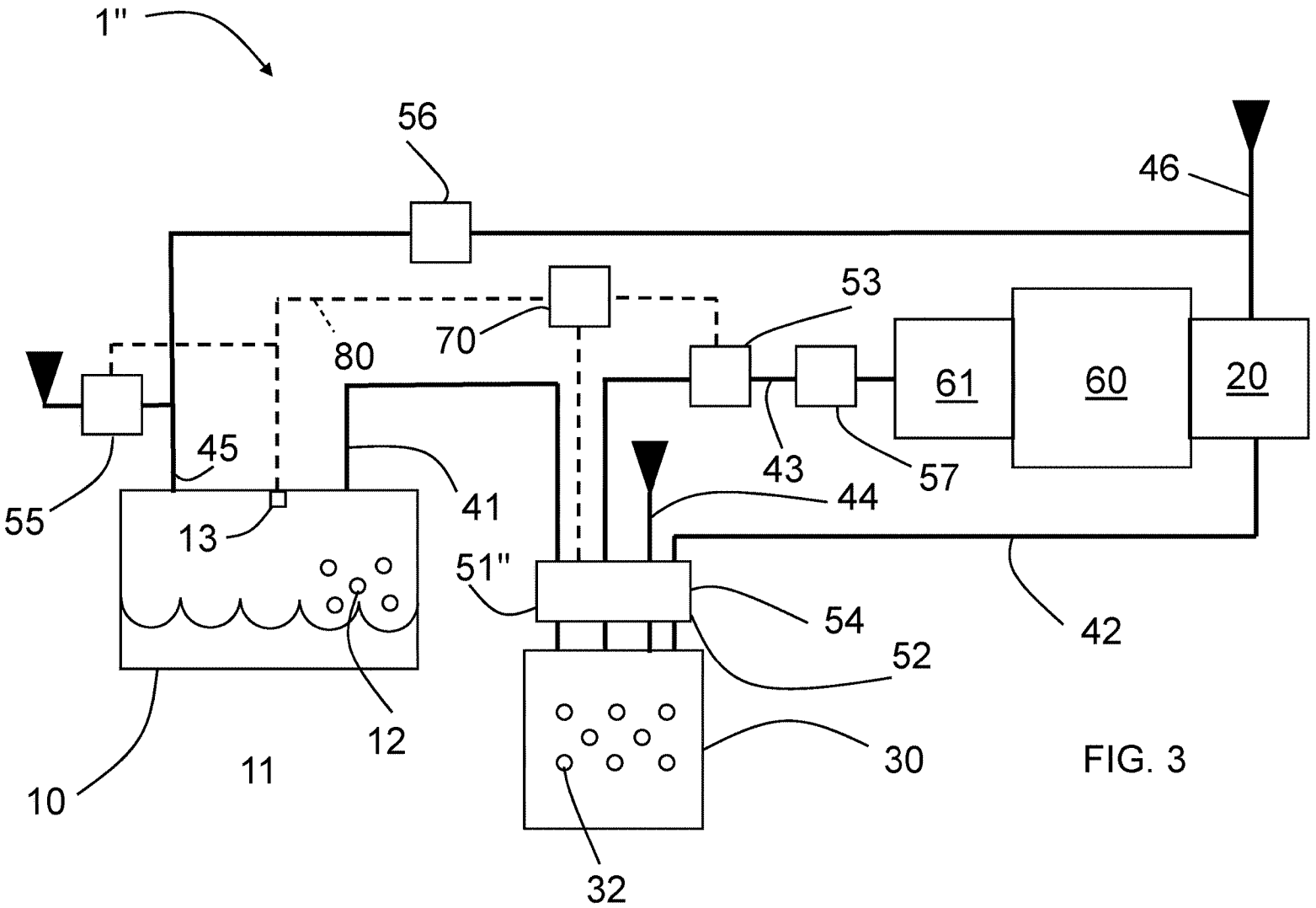
FIG. 3 is a schematic view of another alternate fuel vapor temporary storage device according to the present disclosure.

FIG. 3 shows an alternative fuel vapor temporary storage device 1". This variant has essentially the same features as the fuel vapor temporary storage device 1' in FIG. 2, and further includes a second shut-off valve 52 in the second line 42, which is configured to close off and allow free flow through the 42. In this case, the second valve 52 and the fourth valve 54 are configured such that the second valve 52 closes the second line 42 when the fourth valve 54 allows free flow through the fourth line 44, and the second valve 52 allows free flow through the second line 42 when the fourth valve 54 closes off the fourth line 44. The first valve 51" is also configured in such manner that it closes off the first line 41 when the second valve 52 allows free flow through second line 42 and the first valve 51" allows free flow through the first line 41 when the second valve 52 closes off the second line 42.

The fuel vapor temporary storage device 1' is further equipped with a control unit 70 which is configured to actuate the first, second, third, fourth and fifth valves 51", 52, 53, 54, 55 in such manner via a control line 80 such electrical wires (represented with dashed lines) that it closes off or allows free flow through lines 41, 42, 43, 44, 45. In this context, the first, second and fourth valves 51", 52, 54 are configured as a single unit and are actuated together by the control unit 70 via the control line 80.

Collecting tank or fuel tank 10 is further equipped with a pressure sensor 13 which is configured to capture the pressure prevailing in the interior of collecting tank 10.

Control unit 70 is also configured to receive and evaluate the value captured by pressure sensor 13 and to initiate appropriate measures in the event of overpressure in the collecting tank, such measures being to close the first and second valves or to open the fourth.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

The invention claimed is:

1. A fuel vapor temporary storage device comprising:

a fuel tank configured to store fuel;

a compressor configured to supply compressed air;

a temporary storage device configured to collect gas-phase components of the fuel;

a first line routed between the fuel tank and the temporary storage device for creating a fluid connection therebetween, wherein the temporary storage device is configured to collect the gas-phase components that are released from fuel in the fuel tank via the first line; and a second line routed between the compressor and the temporary storage device for creating a fluid connection therebetween, wherein the temporary storage device is configured to receive compressed air from the compressor via the second line; and a third line configured to discharge the collected gas-phase components from the temporary storage device to an internal combustion engine, wherein the temporary storage device is configured to discharge the collected gas-phase components from the temporary storage device via the third line when the compressor is supplying compressed air to the temporary storage device via the second line.

2. The fuel vapor temporary storage device according to claim 1, further comprising a first check valve in the first line configured to close off the first line in a flow direction from the temporary storage device to the fuel tank.

3. The fuel vapor temporary storage device according to claim 1, further comprising a first valve in the first line configured to close off and allow free flow through the first line.

4. The fuel vapor temporary storage device according to claim 3, further comprising a fourth line routed between the temporary storage device and an outside atmosphere for creating a fluid connection therebetween and a fourth valve in the fourth line configured to close off and allow free flow through the fourth line.

5. The fuel vapor temporary storage device according to claim 4, further comprising a second valve in the second line configured to close off and allow free flow through the second line.

6. The fuel vapor temporary storage device according to claim 5, wherein the second valve and the fourth valve are operable such that the second valve closes off the second line when the fourth valve allows free flow through the fourth line, and the second valve allows free flow through the second line when the fourth valve closes off the fourth line.

7. The fuel vapor temporary storage device according to claim 6, wherein the first valve is operable such that the first valve closes off the first line when the second valve allows free flow through the second line, and the first valve allows free flow through the first line when the second valve closes off the second line.

8. The fuel vapor temporary storage device according to claim 1, wherein the fuel tank comprises a pressure sensor configured to capture a pressure in an interior of the fuel tank.

9. An internal combustion engine comprising a suction device and a temporary storage device according to claim 1, wherein the collected gas-phase components is discharged from the temporary storage device to the suction device of the internal combustion engine via the third line when the compressor is supplying compressed air via the second line.

10. The internal combustion engine according to claim 9 wherein the compressor is driven by the internal combustion engine.

11. A fuel vapor temporary storage device comprising:

a fuel tank configured to store fuel;

a compressor configured to supply compressed air;

a temporary storage device configured to collect gas-phase components of the fuel;

a first line routed between the fuel tank and the temporary storage device for creating a fluid connection therebetween, wherein the temporary storage device is configured to collect the gas-phase components that are released from fuel in the fuel tank via the first line;

a first valve in the first line configured to close off and allow free flow through the first line;

a second line routed between the compressor and the temporary storage device for creating a fluid connection therebetween, wherein the temporary storage device is configured to receive compressed air from the compressor via the second line;

a second valve in the second line configured to close off and allow free flow through the second line;

a third line configured to discharge the collected gas-phase components from the temporary storage device to an internal combustion engine, wherein the temporary storage device is configured to discharge the collected gas-phase components from the temporary storage device via the third line when the compressor is supplying compressed air to the temporary storage device via the second line; and a control unit operably coupled to at least one of the first and second valves and configured to selectively open and close the at least one of the first and second valves.

12. The fuel vapor temporary storage device according to claim 11, where the control unit is operably coupled to first and second valves and configured to selectively open and close the first and second valves.

13. The fuel vapor temporary storage device according to claim 12, further comprising a fourth line routed between the temporary storage device and an outside atmosphere for creating a fluid connection therebetween and a fourth valve in the fourth line configured to close off and allow free flow through the fourth line, wherein the control unit is operably coupled to the fourth valve and configured to selective open and close the fourth valve.

14. The fuel vapor temporary storage device according to claim 13, wherein the control unit is configured to close the second valve when the fourth valve is open, and to open the second valve when the fourth valve is closed.

15. The fuel vapor temporary storage device according to claim 12, wherein the control unit is configured to close the first valve when the second valve is open, and to open the first valve when the second valve is closed.

16. The fuel vapor temporary storage device according to claim 11, wherein the fuel tank comprises a pressure sensor in communication with the control unit and configured to capture a pressure reading in an interior of the fuel tank, wherein the control unit is configure to selectively open and close the at least one of the first and second valves based on the pressure reading.

17. A method for temporarily storing fuel vapor comprising:

collecting gas-phase components that are released from a fuel stored in a fuel tank in a temporary storage device via a first line fluidly connected between the fuel tank and the temporary storage device;

closing a first valve in the first line;

supplying compressed air from a compressor to the temporary storage device via a second line fluidly connected between the compressor and the temporary storage device; and discharging the gas-phase components contained in the temporary storage device to an internal combustion engine via a third line fluidly connected between the temporary storage device and the internal combustion engine when the compressor is supplying compressed air to the temporary storage device via the second line.

* * * * *